US006893226B2

(12) United States Patent
Phipps

(10) Patent No.: US 6,893,226 B2
(45) Date of Patent: May 17, 2005

(54) ROTOR DISC FOR GAS TURBINE ENGINE

(75) Inventor: Anthony B. Phipps, Derby (GB)

(73) Assignee: Rolls-Royce plc, London (GB)

( * ) Notice: Subject to any disclaimer, the term of this patent is extended or adjusted under 35 U.S.C. 154(b) by 9 days.

(21) Appl. No.: 10/393,991

(22) Filed: Mar. 24, 2003

(65) Prior Publication Data

US 2004/0005219 A1 Jan. 8, 2004

(30) Foreign Application Priority Data

Apr. 2, 2002 (GB) ..... 0207554

(51) Int. Cl.[7] ..... B63H 1/20
(52) U.S. Cl. ..... 416/248; 416/219 R; 416/204 A
(58) Field of Search ..... 416/248, 219 R, 416/204 A

(56) References Cited

U.S. PATENT DOCUMENTS

| | | | | | |
|---|---|---|---|---|---|
| 3,891,351 | A | * | 6/1975 | Norbut | 416/219 R |
| 4,260,331 | A | | 4/1981 | Goodwin | |
| 5,609,471 | A | * | 3/1997 | Frasier et al. | 416/204 A |
| 5,846,054 | A | * | 12/1998 | Mannava et al. | 416/219 R |
| 5,863,183 | A | | 1/1999 | Dierksmeier | |
| 6,022,194 | A | | 2/2000 | Ames | |
| 6,174,134 | B1 | * | 1/2001 | Lee et al. | 416/97 R |
| 6,290,466 | B1 | * | 9/2001 | Ravenhall et al. | 416/219 R |

* cited by examiner

*Primary Examiner*—Theresa Trieu
(74) *Attorney, Agent, or Firm*—W. Warren Taltavull; Manelli Denison & Selter PLLC

(57) ABSTRACT

A rotor drive (32) for a gas turbine engine (10) comprising a main drive body (44) having attachment lugs (46) on its radially outer port. The attachment lugs (46) are formed from a different material to the main drive body (44) and are bonded to the main drive body (44) by friction bonding.

12 Claims, 2 Drawing Sheets

ROTOR DISC FOR GAS TURBINE ENGINE

FIELD OF THE INVENTION

The invention relates to a rotor disc for a gas turbine engine.

BACKGROUND OF THE INVENTION

Turbine and compressor assemblies for a gas turbine engine includes a plurality of turbine blades mounted on a generally annular rotor disc so as to protrude radially therefrom. Each blade includes an aerofoil portion, which projects into the path of gases flowing axially through the turbine and compressor, and a root portion which is attached to the rotor disc. Commonly, the blade includes a "firtree" root portion which has as undulating profile and is designed to slide into a complementary recess provided at the surface of the rotor disc.

Turbines and, to a lesser extent compressors, are required to operate at extremely high temperatures and therefore the material of the blades and the disc must be able to withstand such temperatures. A failure of a blade or, even more seriously, of a disc can be extremely serious. The discs are therefore made from materials which are highly heat resistant, resistant to corrosion from cooling air and have very good tensile properties. High strength nickel alloys are commonly used materials.

SUMMARY OF THE INVENTION

According to the invention, there is provided a rotor disc for a gas turbine engine, the rotor disc including a main disc body and a plurality of attachment lugs bonded to a radially outer part of the disc body, the attachment lugs being shaped to enable the attachment of turbine blades thereto, wherein the attachment lugs are made of different material from the disc body and are bonded to the disc body by friction bonding the band line between the disc body and each attachment lug being positioned such that any cracks will generally propagate radially outwardly, thus resulting in the loss of the single attachment lugs.

The attachment lugs may be bonded to the disc body by linear friction bonding. Alternatively, the attachment lugs may be bonded to the disc body by inertia bonding.

Preferably the rotor disc is substantially annular, and the attachment lugs extend radially outwardly from the disc body. Preferably a plurality of attachment lugs are equally spaced around the disc body, each pair of adjacent lugs co-operating to form an attachment recess in which an attachment portion of a turbine blade may be received.

Each attachment lug in a pair may include an undulating, firtree profile defining a side of the respective attachment recess, so that a blade attachment portion having a complementary undulating profile may be slid into engagement with each of the pair of adjacent attachment lugs, to retain the blade on the rotor disc.

Preferably the attachment recess is shaped such that, when a blade is received in the recess, a space is formed between a bottom of the blade and a base of the attachment recess, the space forming a passage for cooling air into the blade. Preferably the bond line between the disc body and each attachment lug is generally radially aligned with the bottom of a turbine blade received by the lug.

Preferably the circumferential extent of each attachment recess is less at the bond line than immediately above or below the bond line.

Preferably the disc body and the attachment lugs are so shaped to minimise stresses at the bond line.

Preferably the material of the attachment lugs is more highly heat resistant than the material of the disc body. Preferably the material of the attachment lugs is also stronger and more highly corrosion resistant than the material of the disc body.

According to the invention, there is further provided a gas turbine engine including a rotor disc according to any of the preceding definitions.

According to the invention, there is further provided a method of manufacturing a rotor disc for a turbine of a gas turbine engine, the rotor disc including a main disc body and a plurality of attachment lugs shaped to enable the attachment of turbine blades thereto, wherein the attachment lugs are made of a different material from the disc body, wherein the method includes the step of bonding the attachment lugs to a radially outer part the disc body by friction bonding, the bond line between the disc body and each attachment lug being positioned such that any cracks will generally propagate radially outwardly, thus resulting in the loss of the single attachment lug.

Preferably the attachment lugs are bonded to a radially outer surface of the disc body.

The attachment lugs may be bonded to the disc body by linear friction bonding. Alternatively the attachment lugs may be bonded to the disc body by inertia bonding.

Preferably the method includes the step of first bonding the material for the attachment lugs to the disc body and subsequently machining the material to shape the attachment lugs.

BRIEF DESCRIPTION OF THE DRAWINGS

An embodiment of the invention will be described for the purpose of illustration only with reference to the accompanying drawings in which.

DETAILED DESCRIPTION OF THE INVENTION

Figure 1:
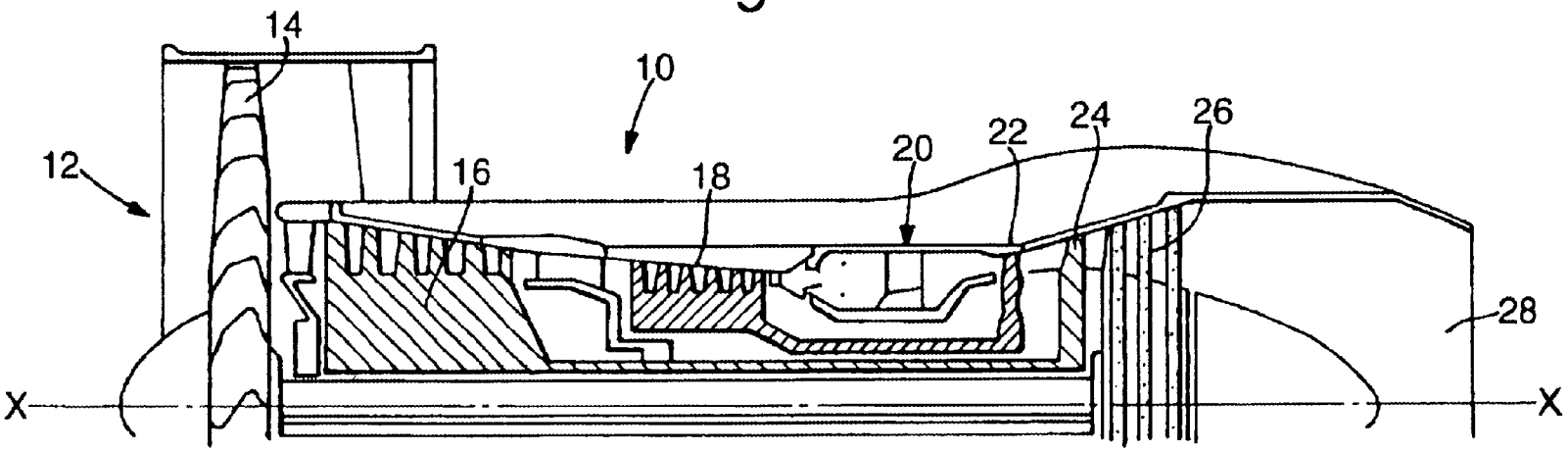
FIG. 1 is a schematic diagram of a ducted fan gas turbine engine.

With reference to FIG. 1 a ducted fan gas turbine engine generally indicated at 10 comprises, in axial flow series, an air intake 12, a propulsive fan 14, an intermediate pressure compressor 16, a high pressure compressor 18, combustion equipment 20, a high pressure turbine 22, an intermediate pressure turbine 24, a low pressure turbine 26 and an exhaust nozzle 28.

The gas turbine engine 10 works in the conventional manner so that air entering the intake 12 is accelerated by the fan 14 to produce two air flows, a first air flow into the intermediate pressure compressor 16 and a second airflow which provides propulsive thrust. The intermediate pressure compressor 16 compresses the air flow directed into it before delivering the air to the high pressure compressor 18 where further compression takes place.

The compressed air exhausted from the high pressure compressor 18 is directed into the combustion equipment 20 where it is mixed with fuel and the mixture combusted. The resultant hot combustion products then expand through and thereby drive the high, intermediate and low pressure turbines 22, 24 and 26 before being exhausted through the nozzle 28 to provide additional propulsive thrust. The high, intermediate and low pressure turbines 22, 24 and 26 respectively drive the high and intermediate pressure compressors 16 and 18 and the fan 14 by suitable interconnecting shafts.

Figure 2:
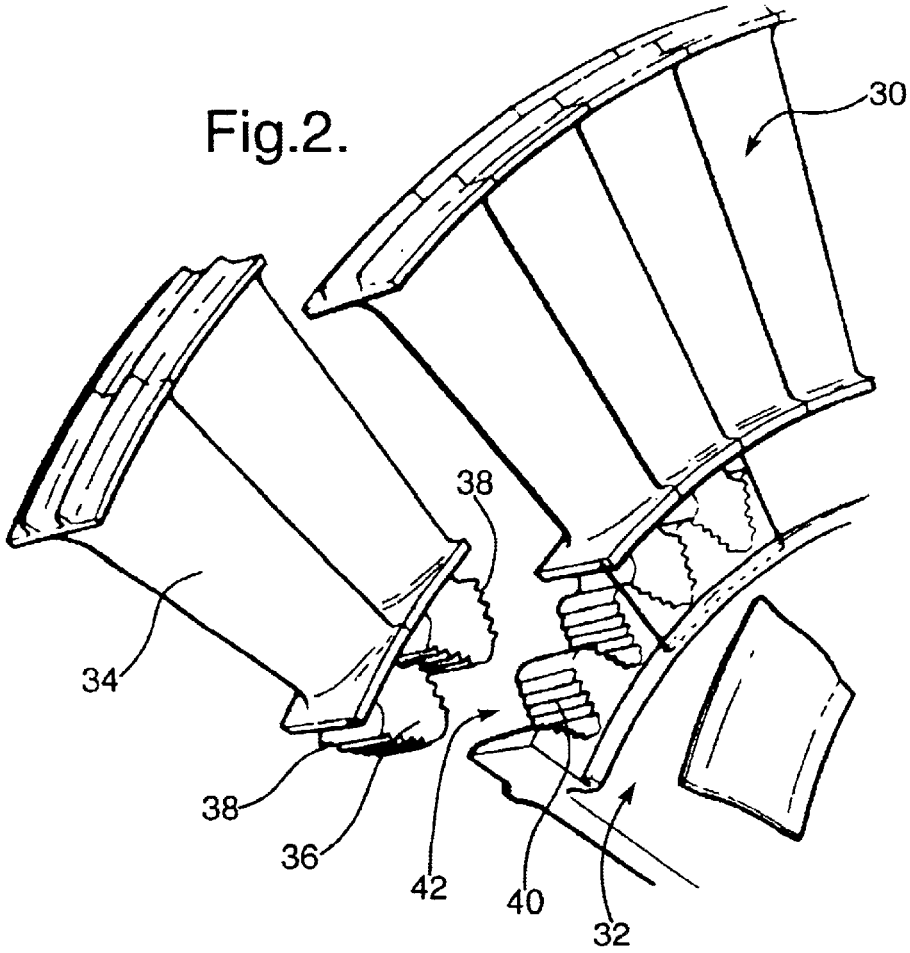
FIG. 2 is a diagrammatic partially exploded perspective view illustrating the mounting of turbine blades on a rotor disc.

Referring to FIG. 2, each turbine 22, 24, 26 includes a set of turbine blades 30 mounted generally in ring formation on a rotor disc 32. Each turbine blade 30 extends generally radially outwardly from the rotor disc 32 and includes an aerofoil portion 34, which is driven by the hot combustion products, and a root portion 36 by means of which the turbine blade 30 is mounted on the rotor disc 32. The root portion 36 of each blade 30 is generally triangular as viewed in the axial direction, but includes serrated or undulating edges 38 which co-operate with complementary edges 40 of a recess 40 in the rotor disc 32. The root portion 36 is freely mounted within the recess 40 when the turbine is stationary, but the connection is stiffened by centrifugal loading when the turbine rotates.

The high thermal efficiency of the engine is dependent upon the gases entering the turbine at high temperatures. Thus, the turbine blades 30 and the rotor disc 32 are made of highly heat resistant materials. In addition, the turbine blades 30 include cooling orifices (not visible in FIG. 2) through which cooling air flows. The cooling air enters the blades 30 through their root portions 36.

Figure 3:
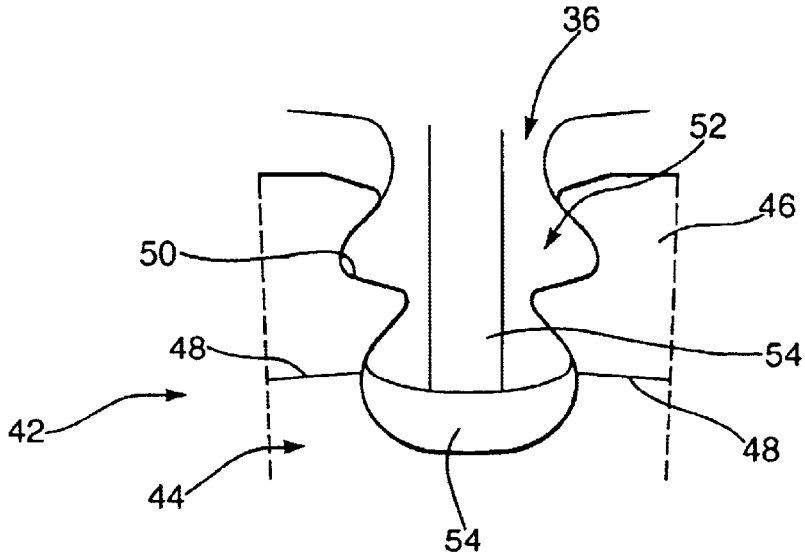
FIG. 3 is a diagrammatic section through a rotor disc according to the invention, mounting a turbine blade.

FIG. 3 illustrates a part of a rotor disc 42 according to the invention. Whereas the prior art rotor disc 32 is machined from a single piece of material, the rotor disc 42 includes a generally annular main disc body 44 made of a first material and attachment lugs 46 made of a second material. A set of attachment lugs 46 are bonded to an outer circumferential surface 48 of the disc body 44 by linear friction bonding or inertia bonding, such that the lugs 46 project radially outwardly from the surface 48 of the disc body 44. The bond line 48 created between the two different materials may be seen in FIG. 3.

Each attachment lug 46 is formed with undulating, firtree edges 50, edges 50 of pairs of adjacent attachment lugs 46 together defining a firtree shaped attachment recess 52 for a turbine blade 30. FIG. 3 illustrates the root portion 36 of the turbine blade in place within the firtree attachment recess 52.

The turbine blade 30 includes a cooling orifice 54 which extends through its root portion 36. An orifice 54 for cooling air is formed at a base of the attachment recess 52, under the root portion 36 of the turbine blade 32 when it is received by the attachment lugs 46. The cooling recess 56 receives cooling air, which then travels into the cooling orifice 54 of the turbine blade 30.

The attachment recess 52 is shaped so as to minimise stresses in the region of the bond line 48. It may be seen that the material of the attachment lug 46 and the disc 44 extends somewhat in to the recess in the region of the bond line 48, in comparison to the material adjacent to the bond line. This tends to minimise stresses in the region of the bond line. The shape of the components and the position of the bond line also ensures that if a crack did start in the region of the bond line it would tend to propagate radially outwardly, thus resulting in the loss of a single attachment lug 46 at worst, rather than a problem with the disc body 44.

By bonding attachment lugs 46 to a disc body 44 to form a rotor disc 42, the attachment lugs may be made of a different material from the disc body. The attachment lugs 46 must withstand higher temperatures than the disc body 44 and must also resist corrosion from cooling air which may include some of the products of combustion. The attachment lugs 46 would tend to be made of high-temperature resistant nickel alloys, titanium alloys or steels, and can be selected to withstand temperatures greater than the disc body to which they attach. Such temperatures could, for example, be above 750° C. The attachment lugs 46 may be made of single crystals, resulting in very high strength.

The disc body 44 is also required to withstand reasonably high temperatures typically, but not exclusively, between 200° C. and 700° C. The disc body must also have a high tensile strength in order that the loss of the single blade does not result in "unzipping" of the disc and the subsequent loss of multiple blades.

Roughly shaped attachment lugs 46 are initially bonded to the disc 44. A single attachment lug at a time may be bonded by linear friction bonding. Alternatively, multiple attachment lugs may be bonded simultaneously by inertia bonding.

There is thus provided a rotor disc which allows the most critical parts to be made of very high specification materials, without the requirement to make the entire disc from such high specification materials. This may be selected to provide cost or integrity benefits. In the rotor disc according to the invention, the disc body 44 may be made of somewhat lower specification materials. Using friction bonding, the area of the bond is sufficiently strong that the overall disc is of similar strength to prior art discs where the whole disc is made of a single material. Although the present invention has primarily been described with reference to a rotor disc for a turbine of a gas turbine engine, it will be appreciated that it could be applicable to a rotor disc for a compressor of a gas turbine engine.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A rotor disc for a gas turbine engine, the rotor disc including a main disc body and a plurality of attachment lugs bonded to a radially outer part of the disc body, the attachment lugs being shaped to enable the attachment of turbine blades thereto, wherein the attachment lugs are made of different material from the disc body and are bonded to the disc body by friction bonding, the bond line between the disc body and each attachment lug being positioned such that any cracks will generally propagate radially outwardly, thus resulting only in the loss of the single attachment lug and wherein the circumferential extent of each attachment recess is less at the bond line than immediately above or below the bond line.

2. A rotor disc according to claim 1 wherein the attachment lugs are bonded to the disc body by linear friction bonding.

3. A rotor disc according to claim 1 wherein the attachment lugs are bonded to the disc body by inertia bonding.

4. A rotor disc according to claim 1 wherein the disc body is generally annular, and the attachment lugs extend radially outwardly from the disc body.

5. A rotor disc according to claim 4, including a plurality of attachment lugs equally spaced around the disc body, each pair of adjacent lugs co-operating to form an attachment recess in which an attachment portion of a turbine blade may be received.

6. A rotor disc according to claim 5 wherein each attachment lug in a pair includes an undulating, firtree profile defining a side of the respective attachment recess, so that a blade attachment portion having a complementary undulating profile is slidable into engagement with each of the pair of adjacent attachment lugs, to retain the blade on the rotor disc.

7. A rotor disc according to claim 5 wherein the attachment recess is shaped such that, when a blade is received in the recess, a space is formed between a bottom of the blade and a base of the attachment recess, the space forming a passage suitable for passing cooling air into the blade.

8. A rotor disc according to claim 7 wherein the bond line between the disc body and each attachment lug is generally radially aligned with the bottom of a turbine blade received by the lug.

9. A rotor disc according to claim 1 wherein the material of the attachment lugs is more highly heat resistant than the material of the disc body.

10. A rotor disc according to claim 1 wherein the material of the attachment lugs is stronger or more highly corrosion resistant than the material of the disc body.

11. A gas turbine engine including a rotor disc according to claim 1.

12. A rotor disc for a gas turbine engine, the rotor disc including a main disc body and a plurality of attachment lugs bonded to a radially outer part of the disc body, the attachment lugs being shaped to enable the attachment of turbine blades thereto, wherein the attachment lugs are made of different material from the disc body and are bonded to the disc body by friction bonding, the bond line between the disc body and each attachment lug being positioned such that any cracks will generally propagate radially outwardly, thus resulting only in the loss of the single attachment lug wherein the disc body and the attachment lugs are so shaped to minimize stresses at the bond line.

* * * * *